United States Patent [19]

Pillinini

[11] Patent Number: 4,681,379

[45] Date of Patent: Jul. 21, 1987

[54] SLIDING SHUTTER DOOR SECTIONAL WARDROBE

[76] Inventor: Bruno Pillinini, Via Paschini 11, 33028 Tolmezzo (UD), Italy

[21] Appl. No.: 941,558

[22] Filed: Dec. 11, 1986

Related U.S. Application Data

[63] Continuation of Ser. No. 669,686, Nov. 9, 1984, abandoned.

[51] Int. Cl.[4] ..... E06B 9/14

[52] U.S. Cl. ..... 312/297; 160/229 R; 160/236

[58] Field of Search ..... 312/297; 160/232, 236, 160/201, 229, 264

[56] References Cited

U.S. PATENT DOCUMENTS

| | | | |
|---|---|---|---|
| 45,366 | 12/1884 | Vrydagh | 312/297 |
| 292,047 | 1/1884 | Recker | 312/297 |
| 427,841 | 5/1890 | Davis | 312/297 |
| 531,944 | 1/1895 | Hummel | 312/297 |
| 1,231,233 | 6/1917 | Bertram | 312/297 |
| 2,109,039 | 2/1938 | Turner | 312/297 |
| 2,140,836 | 12/1938 | Gerhardt | 312/297 |
| 2,465,423 | 3/1949 | Bonkowski et al. | 160/232 |
| 3,110,533 | 11/1963 | Le Bron | 312/297 |
| 3,679,280 | 7/1972 | Friederich et al. | 312/6 |

FOREIGN PATENT DOCUMENTS

| | | |
|---|---|---|
| 884754 | 9/1969 | Italy . |
| D. 140948 | 9/1969 | Italy . |

*Primary Examiner*—Joseph Falk

*Attorney, Agent, or Firm*—Staas & Halsey

[57] ABSTRACT

This invention relates to a sliding shutter door sectional wardrobe, particulary for floor-to-ceiling building wardrobes and for built-in wardrobes, comprising:

a guide floor frame with an attached upward disposed sliding shutter door track-way;

a guide ceiling frame with an attached downward disposed sliding shutter door track-way;

a guide frame supporting means to connect and support rigidly said guide floor and ceiling frames;

at least one but preferably two opposed, sliding shutter doors comprising a plurality of rolling hinged lath means, said sliding shutter doors disposed between said opposed guide floor and ceiling frames in sliding condition, to close the composite wardrobe at least frontally and laterally.

8 Claims, 16 Drawing Figures

FIG. 5
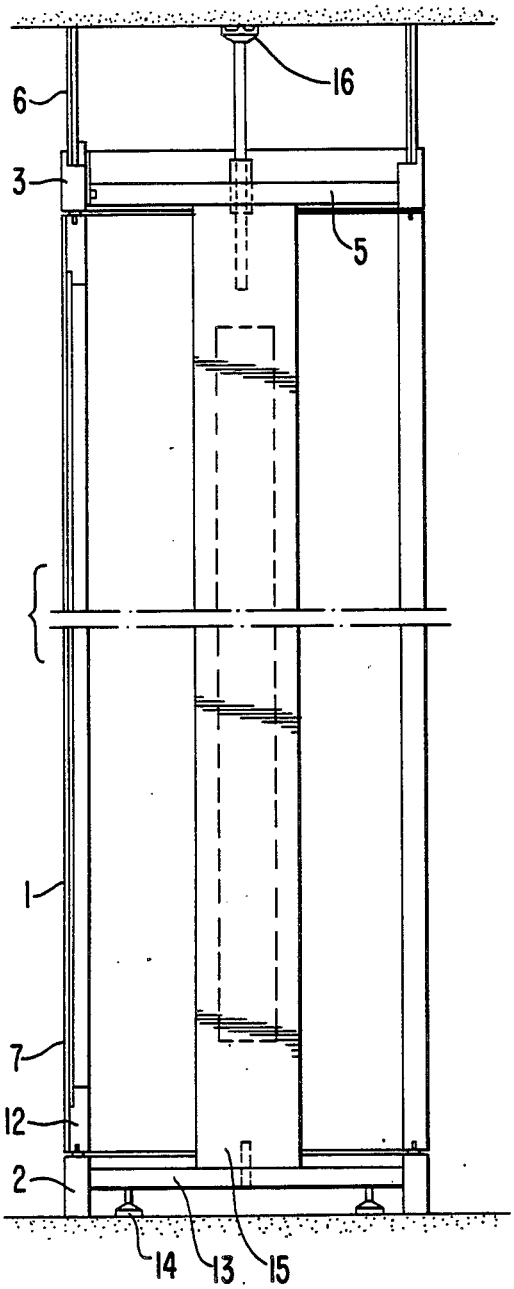
FIG. 6
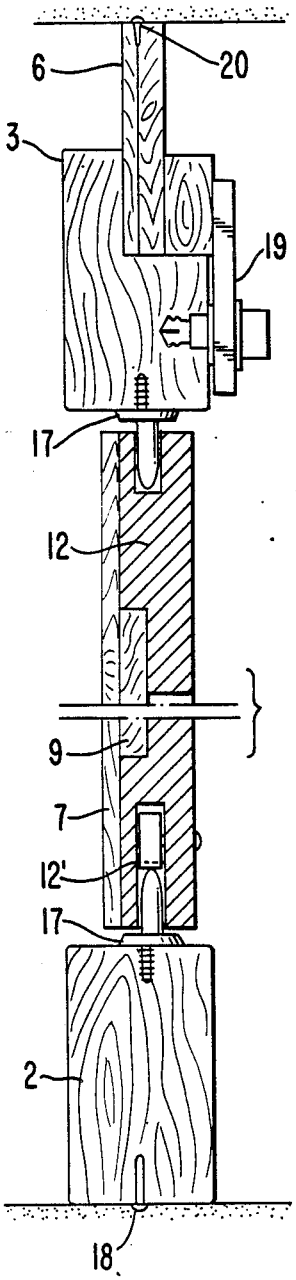
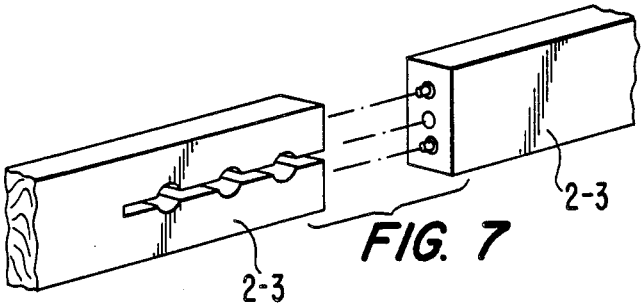
FIG. 7

SLIDING SHUTTER DOOR SECTIONAL WARDROBE

This is a continuation of co-pending application Ser. No. 669,686 filed on 11/9/84 now abandoned.

BACKGROUND OF THE INVENTION

The present invention relates to a sliding shutter door sectional wardrobe.

The invention is particularly useful producing pieces of furniture, such as a wardrobe both as separate pieces of furniture and preferably as built-in wardrobes or cupboards.

At the present state of the art, sliding shutter door sectional wardrobes are well known. Reference is made to the Italian Pat. No. 884754, filed on Sept. 19, 1969 in the name of the same Inventor, and to the Italian Registered Design No. 140948 filed on Sept. 26, 1969 in the name of the same Inventor, concerning:

"A sliding shutter door for closet furniture, realized by strips of wood or laths connected by two opposed glued connecting clothes; and "Eleven pieces of furniture for bedrooms with closet furniture sliding shutter door", respectively.

In these referenced patents a normal structure of wooden closet furniture is provided comprising a traditional box construction with closing ground panel, closing ceiling panel, closing back panel, closing side panels and said frontal sliding shutter doors, sliding in opposed pathways disposed inside said closing ground and ceiling panels, said sliding shutter doors manufactured to provide rolling hinging by a plurality of exterior laths and corresponding opposed glued interior counterlaths. There is disposed between the opposed glued surfaces a connecting cloth to provide the hinging function and there is further glued a second covering cloth in the counterlaths interior surfaces.

These referenced items are restrictive since the utilization of said wooden strips and counterstrips cannot allow the realization of floor to ceiling wardrobes because the sliding shutter doors become heavy and not straight. Furthermore, use of covering cloth increases the respective production costs. But the main drawbacks concern:

- the restriction on fitness of the furniture to the various furnishing requirements;
- nonsectional furniture, which do not allow the production of different constructions and dimensions in length and height;
- very high non competitive production costs.

DESCRIPTION OF THE INVENTION

The invention as claimed is intended to provide a remedy to the above-mentioned disadvantages. It solves the problem providing a wardrobe kit of components particularly for floor-to-ceiling building wardrobes also for built-in wardrobes, comprising:

- a guide floor frame with an attached upward disposed sliding shutter door track-away;
- a guide ceiling frame with an attached downward disposed sliding shutter door track-way;
- supporting means to connect and support rigidly fixed in opposed condition said guide floor and ceiling frames;
- at least one but preferably two opposed, sliding shutter doors comprising a plurality of rolling hinged lath means, said sliding shutter doors disposed between said opposed guide floor and ceiling frames in sliding condition, to close the composite wardrobe at least frontally and laterally.

In a preferred embodiment the kit is completed by at least one partial back panel.

In a further preferred embodiment said sliding shutter doors are manufactured with an interior hinged lath connection comprising a plurality of exterior laths and corresponding opposed glued beveled interior counterlaths enclosing between the opposed glued surfaces a connecting cloth or flexible net to provide the hinging function wherein each counterlath further comprises a reinforcing straightening profile.

In a further preferred embodiment said reinforcing straightening profile is made of metallic light aluminum alloy.

The advantages offered by this invention are mainly that with this solution it is possible to realize different wardrobe compositions in different sizes depending on the various furnishing requirements, where the wardrobe can be built in situ utilizing a kit. The composition can be adapted to different geometrical shapes at very competitive production and assembling costs; since the components are adaptable in length, particularly for the respective mountable elements of the guide floor and ceiling frame and the sliding shutter doors can be packed in rolls.

One way of carrying out the invention is described in detail below with reference to drawings which illustrate some preferred embodiments, in which:

FIG. 5 is an enlarged side section (A—A) view of the parallelepiped wardrobe mounted between floor and ceiling;

FIG. 6 is a further enlarged vertical section view of the mounted sliding shutter door slidable placed between the respective guide floor frame and guide ceiling frame;

FIG. 7 is perspective view of the connection system between the sectional guide frame elements;

Figure 1:
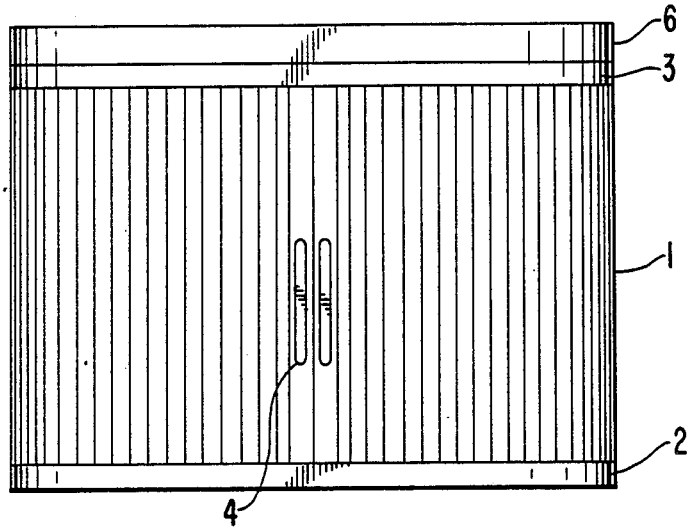
FIG. 1 is a schematic frontal view of a parallelepiped wardrobe.
Figure 2:
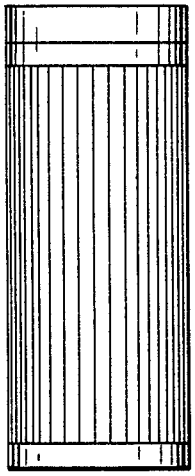
FIG. 2 is a side view of the wardrobe of FIG. 1.
Figure 3:
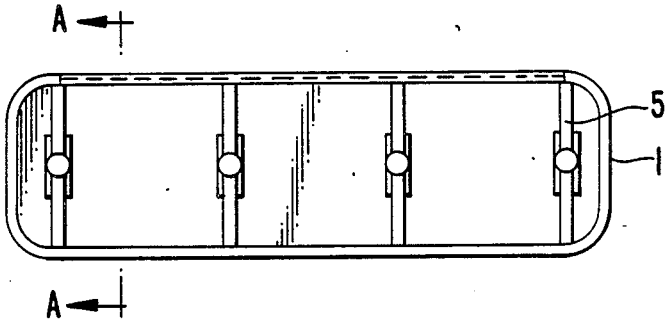
FIG. 3 is a plan view of the wardrobe of FIG. 1.

According to the above figures the wardrobe consists of:

a guide floor frame (2) with an attached upward disposed sliding shutter door track-way (17);

a guide ceiling frame (3) with an attached downward disposed sliding shutter door track-way (17);

supporting means (15,25) to connect and support rigidly fixed in opposed condition said guide floor and ceiling frames (2,3);

at least one but preferably two opposed, sliding shutter doors (1) comprising a plurality of rolling hinged lath means, said sliding doors placeable between said opposed guide floor and ceiling frames (2,3) in sliding condition, to close the composite wardrobe by means of end handles (4), at least frontally and laterally.

Between said guide ceiling frame (3) and the ceiling a covering lath (6) is placed fixed by clamping means (19). Sealing means (20,18) are provided for sealing against the ceiling and the floor respectively.

In the parallelepiped embodiment said supporting means (15) constitute intermediate panels connected with upper and lower guide frame transom means (5,13) fixed into the respective guide frames (2,3). The structure thus composed can be fixed between the floor and the ceiling by upper and lower screw means (16,14).

The respective guide frames (2,3) are decomposable as shown in FIG. 7 utilizing non illustrated but well known head connecting screw means.

Figure 10:
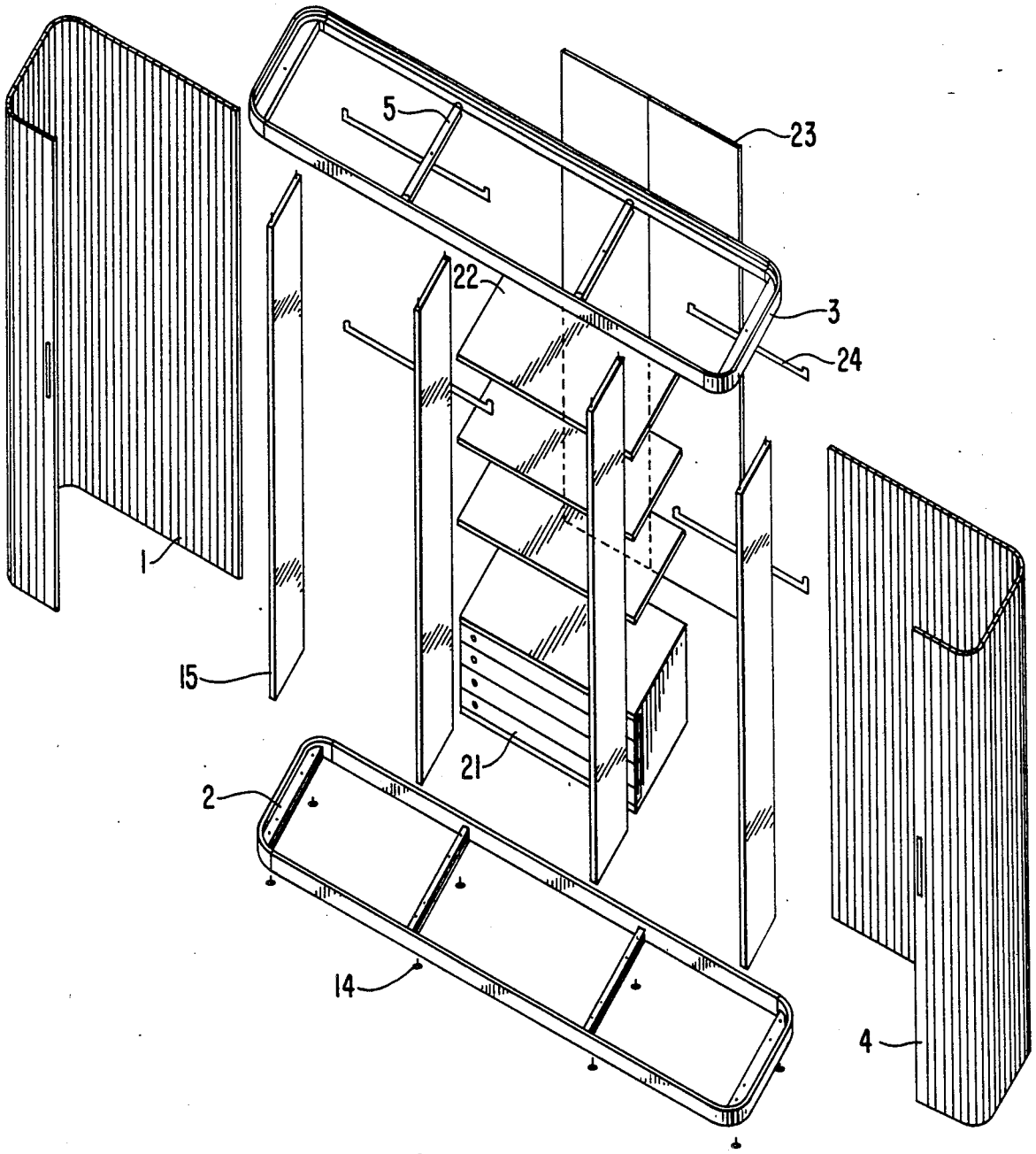
FIG. 10 is an exploded perspective view of the parallelepiped wardrobe as shown in the preceding Figures.

Referring now to FIG. 10, there can be placed between at least two supporting intermediate panel means (15) drawer means (21) and shelf means (22).

Both the guide ceiling frame (3) and the support intermediate panel means (15) can support clothing hang-up means (24).

At least one back panel (23) is provided backward to cover the back between two support intermediate panel means (15) backing said drawer means (21) and shelf means (22). A back panel not necessary in the other lateral back surfaces since they will be covered by opening the respective sliding shutter door (1). Preferably to provide a sealing between said sliding shutter doors (1) and the back panel 23 a vertical sealing or brush sealing is placed to avoid dust getting into the wardrobe.

Figure 4:
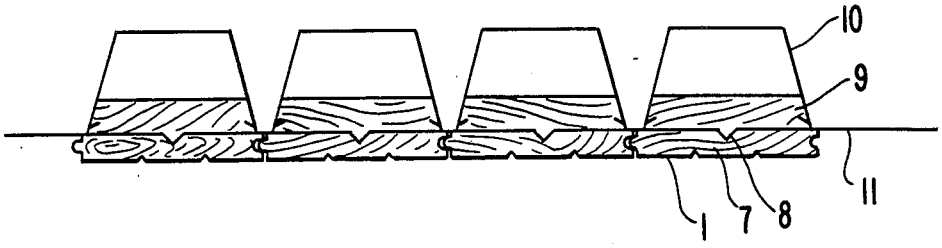
FIG. 4 is an enlarged transversal section of a sliding shutter door.
Figure 8:
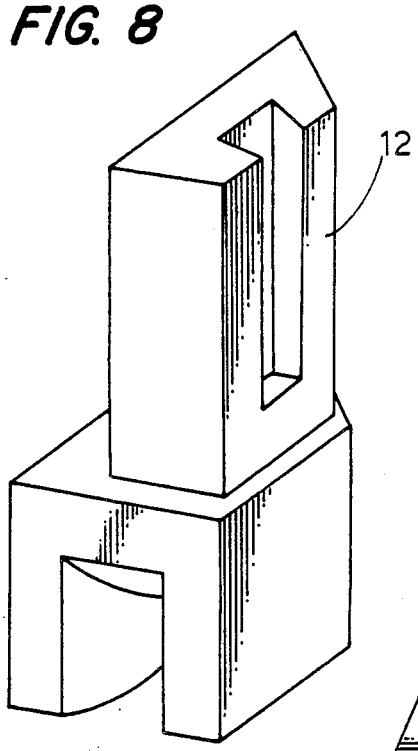
FIG. 8 is a perspective view of a sliding track-way guide head insert upward insertable in said reinforcing profile of said sliding shutter door.
Figure 9:
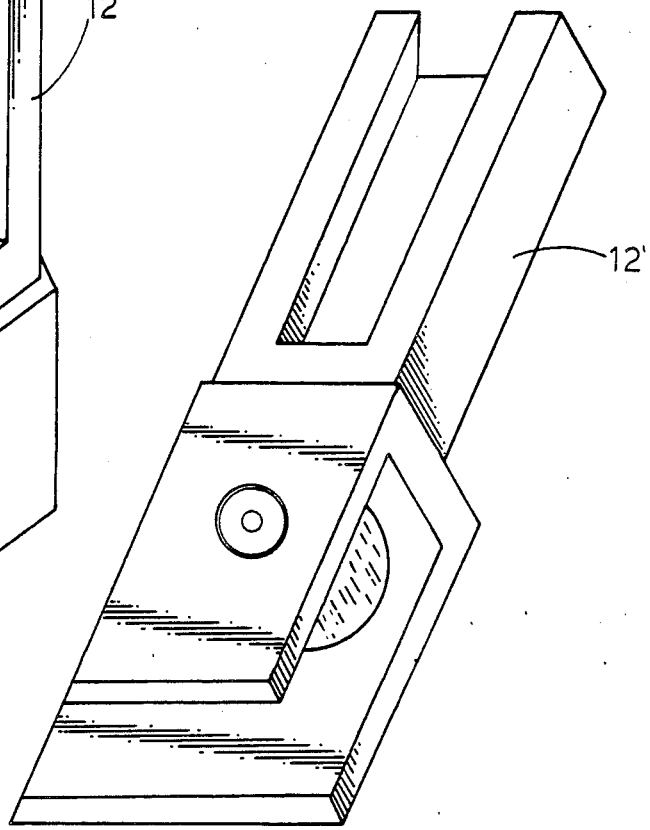
FIG. 9 is a perspective view of a rolling track-way guide head insert downward insertable in said reinforcing profile of said sliding shutter door in alternate insertion with same of said slide guide heading inserts.

The interior rolling hinged sliding shutter doors (1) comprise a plurality of exterior wood laths (7) and corresponding juxtaposed (8) opposed glued beveled interior light wood counterlaths (9) enclosing between the opposed glued surfaces a connecting cloth or flexible sheet or flexible plastic net (11) with the hinging function comprising a reinforcing straightening metallic light aluminum alloy profile (10) mounted on each counterlath (9). As shown in FIG. 4, each reinforcing profile 10 is tubular in configuration and has side flanges which cover the lateral edges of each counterlath 9 to encase each counterlath. The respective opened heads of each reinforcing profile (10) are closed upward by a sliding track-way guide head insert (12) and downward with similar rolling track-way guide insert (12') in alternate placement shown in FIGS. 8 and 9, to facilitate the sliding of the respective sliding doors on opposed track-ways (17).

The track-ways (17) are usually made of a plastic material and are inserted in the guide frame (2,3).

Figure 11:
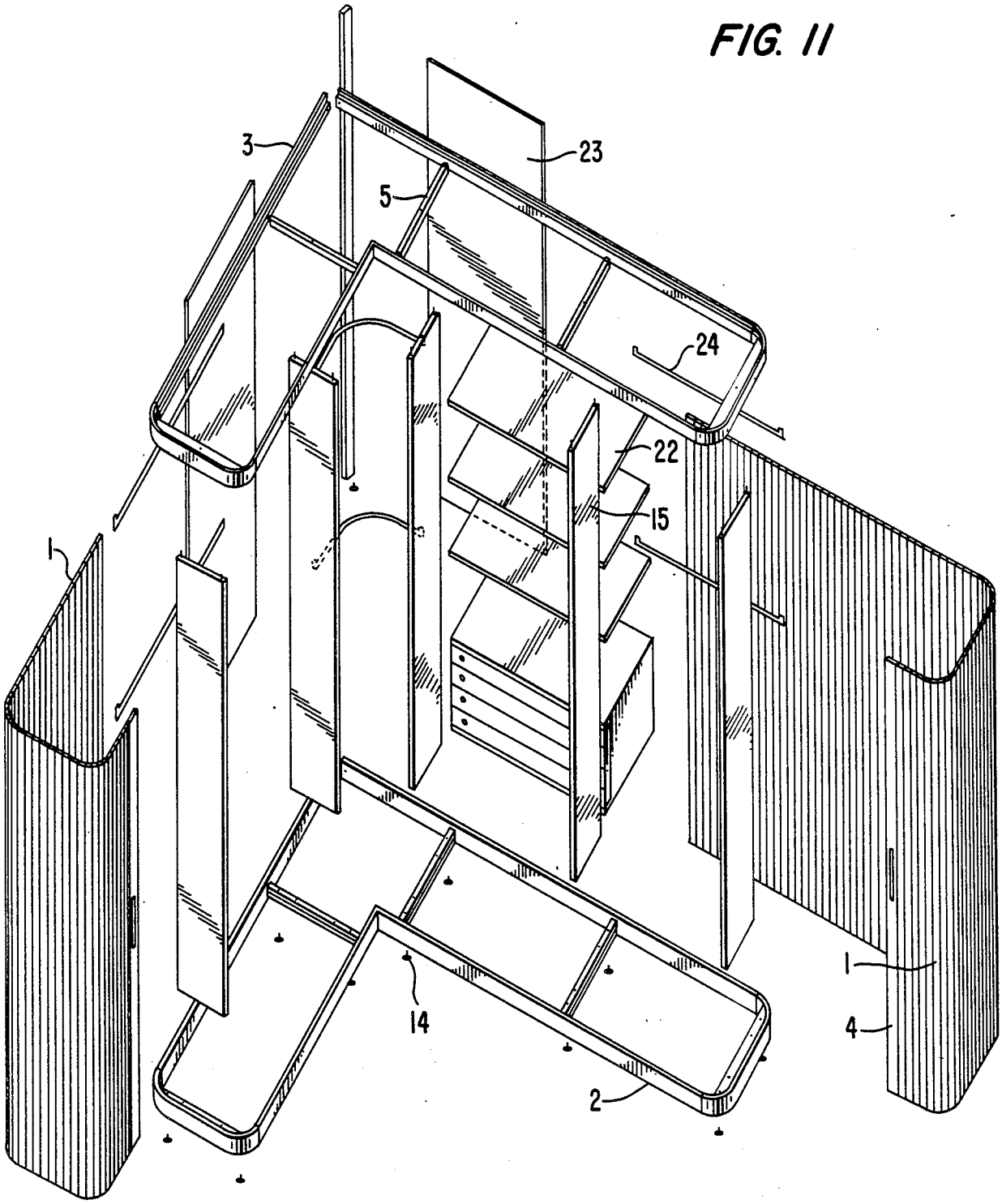
FIG. 11 is an exploded perspective view of the parallelepiped wardrobe in a corner placement construction.
Figure 12:
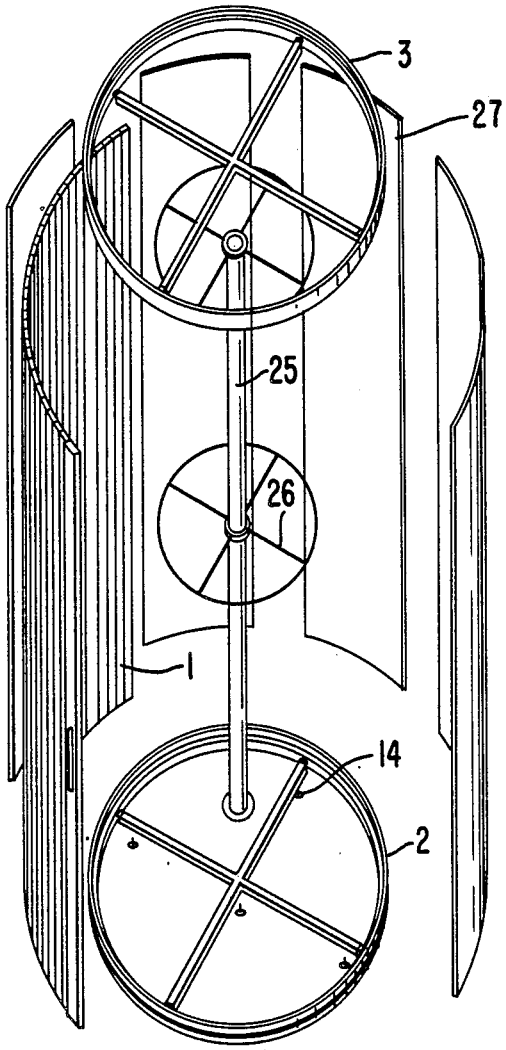
FIG. 12 is an exploded cylindrical composition.
Figure 13:
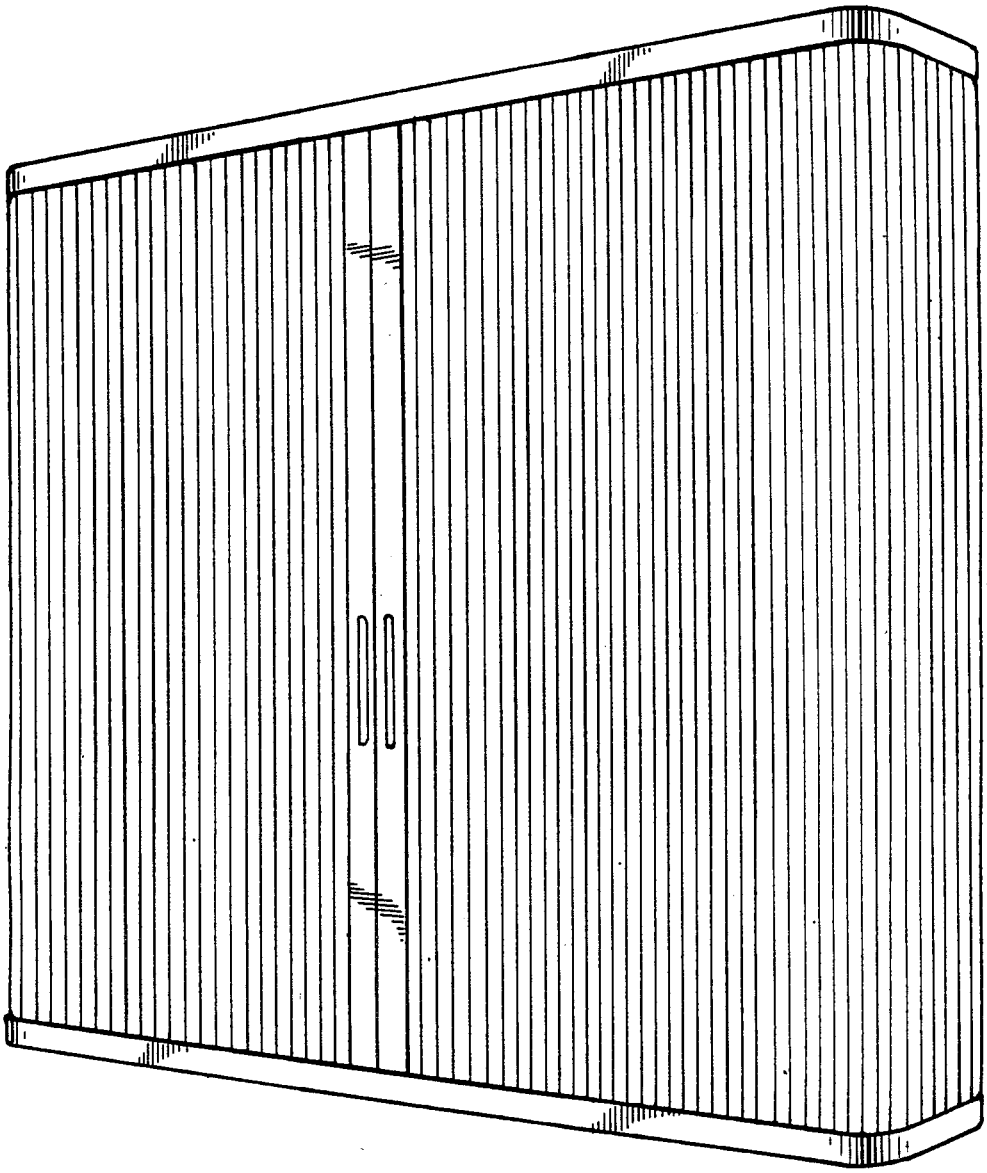
FIG. 13 is a perspective view of a parallelepiped wardrobe with sliding shutter doors closed.
Figure 14:
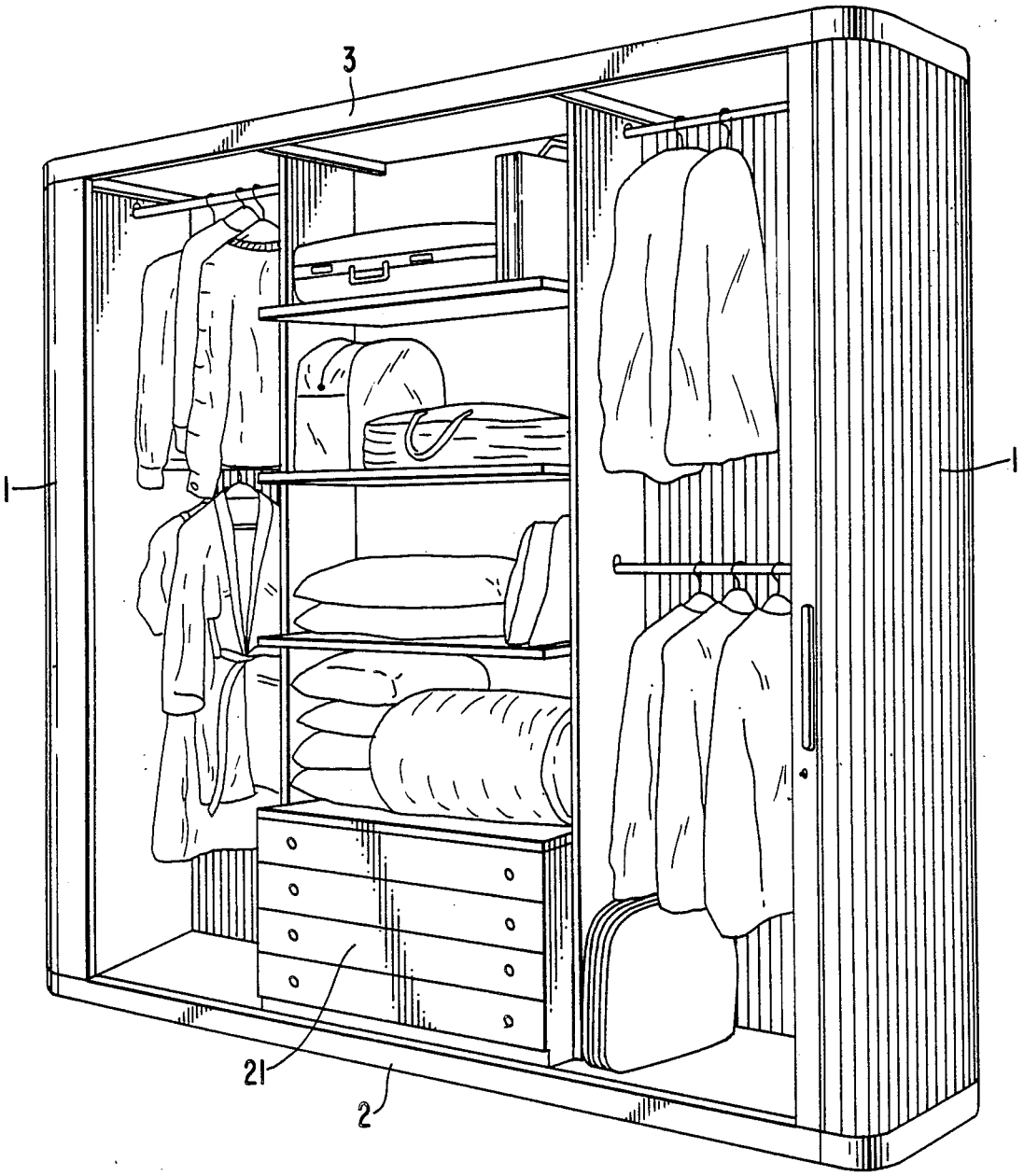
FIG. 14 shows the same parallelepiped wardrobe with the respective doors open.
Figure 15:
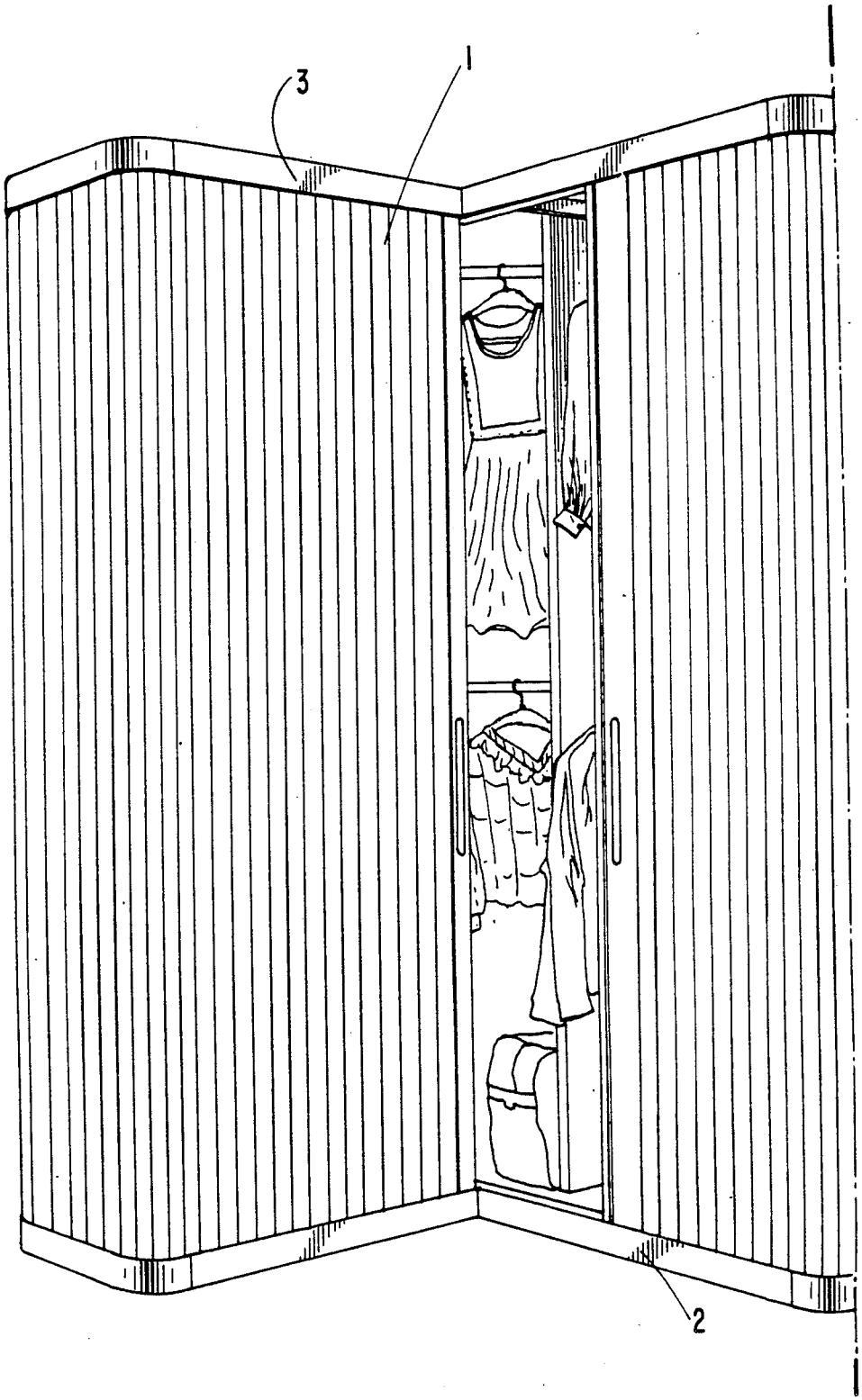
FIG. 15 is a perspective view of a parallelepiped wardrobe in corner construction with a sliding shutter door partially open.
Figure 16:
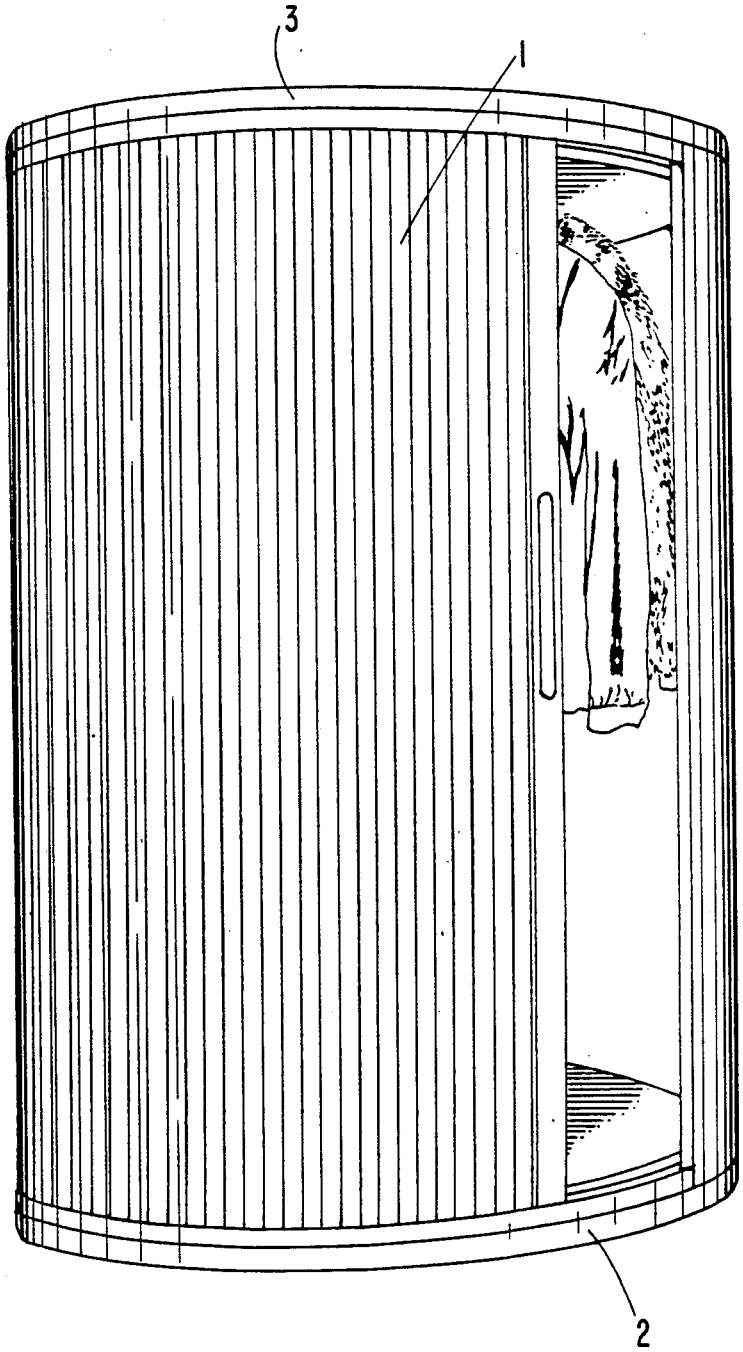
FIG. 16 is a perspective view of the cylindrical wardrobe with a sliding shutter door partially open.

As shown in FIG. 11, the parallelepiped embodiment can also be manufactured as a corner piece with different lengths. The wardrobe can be made also in cylindrical form as shown in FIG. 12 utilizing respective circular guide frames (2,3) being the supporting structure comprising a vertical central shaft (25). The hinge clothes can be realized in the same form (26) and fixed on the central shaft (25). A single sliding shutter door (1) can be provided with a plurality of semicylindrical spaced apart back panels (27) FIGS. 13, 14, 15 and 16 show alternative shapes and configurations for the wardrobe of this invention.

Having thus described the invention, I claim:

1. A sliding shutter door sectional wardrobe, particularly for floor-to-ceiling building wardrobes and for built-in wardrobes, comprising:

a guide floor frame to which is attached an upward disposed sliding shutter door track-way;

a guide ceiling frame to which is attached a downward disposed sliding shutter door track-way;

guide frame supporting means to connect and support rigidly said guide floor and ceiling frames;

at least one sliding shutter door comprising a plurality of rolling hinged lath means, said sliding door disposed between said floor and ceiling trackways, to close the composite wardrobe frontally and laterally; wherein said sliding shutter door comprises an interior hinged lath connection consisting of a plurality of exterior laths and corresponding opposed glued interior counterlaths enclosing between the opposed glued surfaces a connecting flexible sheet to provide the hinging function and wherein each counterlath comprises a reinforcing straightening profile means mounted thereon, each said reinforcing profile means being of tubular configuration with side flanges which cover the lateral edges of each counterlath to encase each counterlath.

2. The sliding shutter door sectional wardrobe of claim 1, further comprising at least one partial back panel.

3. The sliding shutter door sectional wardrobe of claim 1 wherein said reinforcing straightening profile made is made of metallic light aluminium alloy.

4. The sliding shutter door sectional wardrobe of claim 1 comprising upper and lower guide frame transom means, a plurality of intermediate panel supporting means, fixedly attached to said upper and lower guide frame transom means, said upper and lower guide frame transom means fixedly attached to the respective guide frames, the entire structure being fixed between the floor and the ceiling by upper and lower screw means.

5. The sliding shutter door sectional wardrobe of claim 4, further comprising between at least two intermediate panel support means, a drawer means and shelf means fixedly attached to said intermediate panel supporting means and further comprising at least one back panel also fixedly attached to said intermediate panel support means.

6. The sliding shutter door sectional wardrobe of claim 1, wherein said floor and ceiling guide frames are circular, comprising radial supports attached within said circular floor and ceiling guide frames and comprising a vertical central shaft to connect said floor and ceiling guide frames.

7. The sliding shutter door sectional wardrobe of claim 1, wherein said exterior lath means are tongue and groove connectable.

8. The sliding shutter door sectional wardrobe of claim 1, wherein said reinforcing straightening profiles of said sliding shutter doors are tubular with open heads each respective open head closed upward by a sliding track-way guide insert and downward by a rolling track-way guide insert to facilitate the sliding of the respective sliding door on its opposed track-ways.

* * * * *